US005799505A

United States Patent [19]

Bonaquist et al.

[11] Patent Number: 5,799,505

[45] Date of Patent: Sep. 1, 1998

[54] SYSTEM FOR PRODUCING CRYOGENIC LIQUEFIED INDUSTRIAL GAS

[75] Inventors: Dante Patrick Bonaquist, Grand Island; Nancy Rose Cribbin, Buffalo; Joseph Alfred Weber, Cheektowaga; John Fredric Billingham, Getzville; Neno Todorov Nenov, Williamsville, all of N.Y.

[73] Assignee: Praxair Technology, Inc., Danbury, Conn.

[21] Appl. No.: 901,350

[22] Filed: Jul. 28, 1997

[51] Int. Cl.[6] ..... F25J 3/00

[52] U.S. Cl. ..... 62/613; 62/615; 62/908

[58] Field of Search ..... 62/613, 619, 908, 62/615

[56] References Cited

U.S. PATENT DOCUMENTS

| | | | |
|---|---|---|---|
| 3,616,652 | 11/1971 | Engel | 62/613 |
| 3,677,019 | 7/1972 | Olszewski | 62/9 |
| 4,141,707 | 2/1979 | Springmann | 62/615 |
| 4,177,645 | 12/1979 | Schwarz | 62/619 |
| 4,778,497 | 10/1988 | Hanson et al. | 62/11 |
| 5,231,835 | 8/1993 | Beddome et al. | 62/9 |
| 5,518,526 | 5/1996 | Baksh et al. | 95/100 |
| 5,584,194 | 12/1996 | Gardner | 62/615 |

*Primary Examiner*—Ronald C. Capossela
*Attorney, Agent, or Firm*—Stanley Ktorides

[57] ABSTRACT

A system for producing cryogenic liquefied industrial gas, especially useful in conjunction with a non-cryogenic industrial gas production facility, wherein the output of the industrial gas production facility is pressurized, a portion passed to the use point, and another portion is condensed against a turboexpanded stream which is also taken from the pressurized gas.

8 Claims, 1 Drawing Sheet

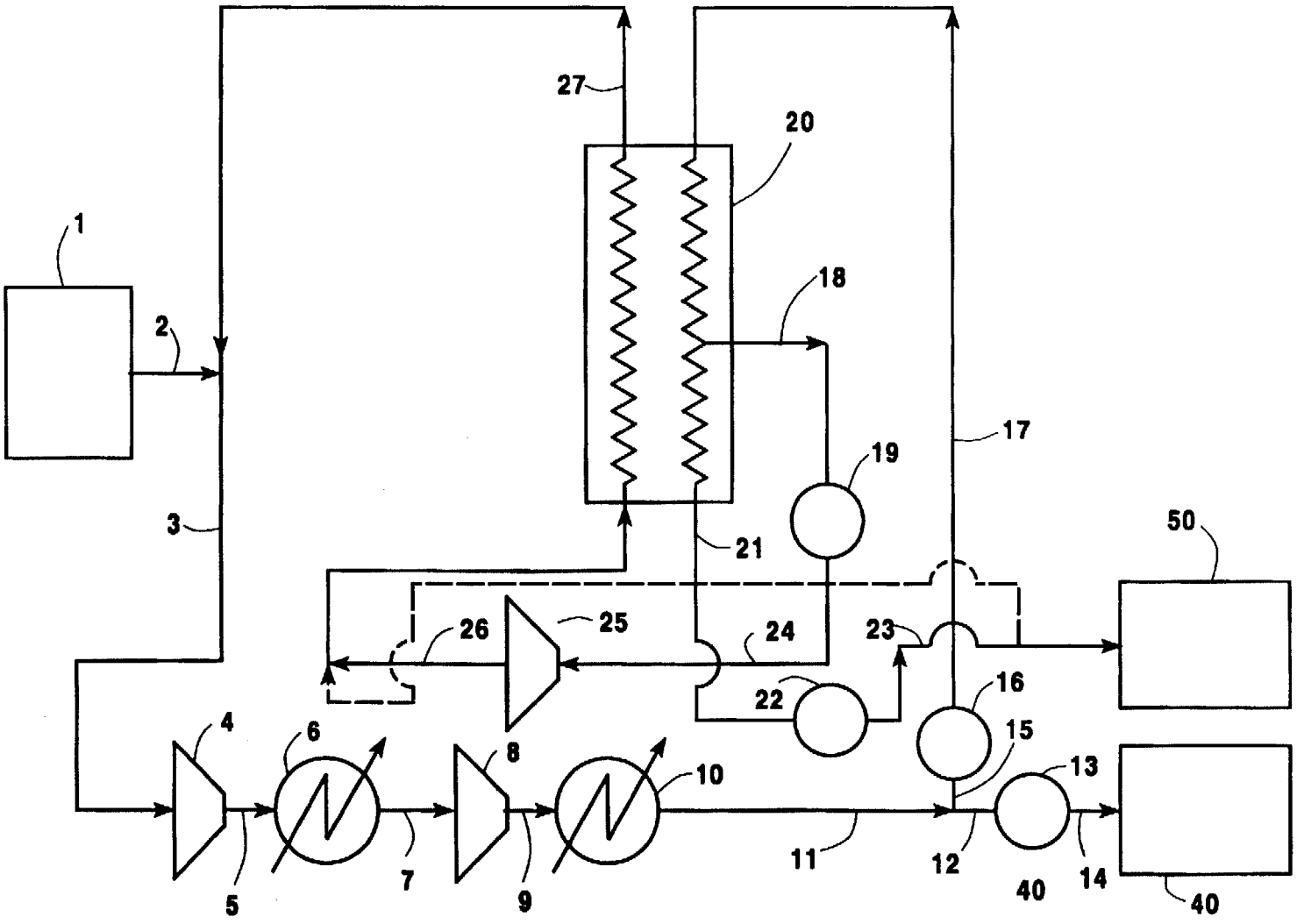
1
2
3
4
5
6
7
8
9
10
11
12
13
14
15
16
17
18
19
20
21
22
23
24
25
26
27
40
40
50

SYSTEM FOR PRODUCING CRYOGENIC LIQUEFIED INDUSTRIAL GAS

TECHNICAL FIELD

This invention relates generally to the liquefaction of industrial gas and, more particularly, to the provision of industrial gas in the gaseous state to a use point simultaneously with the production of cryogenic liquefied industrial gas.

BACKGROUND ART

Industrial gases, such as oxygen or nitrogen, may be produced in the gaseous state and delivered from a production facility directly to a use point. A storage facility which holds industrial gas is located proximate the use point and is used as a backup source of industrial gas in the event production of the industrial gas from the production facility is disrupted. The storage facility holds the industrial gas in the liquid state so that the storage volume of the facility is minimized, and the liquid industrial gas is vaporized when needed by the use point. When the production facility is not a cryogenic rectification plant which can produce cryogenic liquefied industrial gas in addition to industrial gas in the gaseous state, the storage facility is periodically refilled with liquid industrial gas which is transported to the storage facility, such as by tanker truck, from a distant production facility which produces liquefied industrial gas. This long distance transport for refilling the storage facility is expensive and thus inefficient.

Accordingly, it is an object of this invention to provide a system which can be used in conjunction with a non-cryogenic or cryogenic industrial gas production facility and can be located proximate an industrial gas use point for producing cryogenic liquefied industrial gas for the storage facility associated with that use point.

SUMMARY OF THE INVENTION

The above and other objects, which will become apparent to one skilled in the art upon a reading of this disclosure, are attained by the present invention, one aspect of which is:

A method for producing cryogenic liquefied industrial gas comprising:

(A) passing industrial gas feed to compression means, compressing the industrial gas feed to produce elevated pressure industrial gas, and passing a first portion of the elevated pressure industrial gas to a use point;

(B) cooling a second portion of the elevated pressure industrial gas to produce cooled industrial gas, and condensing a third portion of the elevated pressure industrial gas to produce cryogenic liquefied industrial gas;

(C) turboexpanding the cooled industrial gas to produce turboexpanded industrial gas, and warming the turboexpanded industrial gas by indirect heat exchange with the second and third portions of the elevated pressure industrial gas to produce warmed turboexpanded industrial gas and said cooled industrial gas and said cryogenic liquefied industrial gas; and (D) passing the warmed turboexpanded industrial gas to said compression means as part of said industrial gas feed.

Another aspect of the invention is:

Apparatus for producing cryogenic liquefied industrial gas comprising:

(A) compression means for compressing an industrial gas feed to a use pressure;

(B) a heat exchanger, means for passing industrial gas from the compression means to a use point, and means for passing industrial gas from the compression means to the heat exchanger;

(C) a turboexpander, means for withdrawing cryogenic liquefied industrial gas from the heat exchanger, and means for passing industrial gas from the heat exchanger to the turboexpander and from the turboexpander to the heat exchanger; and (D) means for passing industrial gas from the heat exchanger to the compression means as industrial gas feed.

As used herein, the term "industrial gas" means a fluid which comprises primarily oxygen or nitrogen. Examples include the primary product or products of a cryogenic or non-cryogenic air separation facility, as well as purified air.

As used herein, the term "indirect heat exchange" means the bringing of two fluid streams into heat exchange relation without any physical contact or intermixing of the fluids with each other.

As used herein, the term "cryogenic liquefied industrial gas" means an industrial gas liquid having a temperature of 150° K. or less at normal pressure.

As used herein, the terms "turboexpansion" and "turboexpander" mean respectively method and apparatus for the flow of high pressure gas through a turbine to reduce the pressure and the temperature of the gas, thereby generating refrigeration.

As used herein the term "compressor" means a device which accepts gaseous fluid at one pressure and discharges it at a higher pressure.

BRIEF DESCRIPTION OF THE DRAWINGS

The sole FIGURE is a simplified schematic representation of one preferred embodiment of the cryogenic liquefied industrial gas production system of this invention.

DETAILED DESCRIPTION

The invention will be described in detail with reference to the FIGURE with oxygen as the industrial gas fluid and the source of the oxygen being a non-cryogenic industrial gas production facility.

Referring now to the FIGURE, non-cryogenic industrial gas production facility 1, which may, for example be a vacuum pressure swing adsorption facility or a membrane separation facility, produces industrial gas product fluid 2. Those skilled in the art are familiar with the terms vacuum pressure swing adsorption facility and membrane separation facility as well as their meanings. When the industrial gas production facility is an oxygen production facility, product fluid 2 comprises from about 30 to 99.5 mole percent oxygen; when the industrial gas production facility is a nitrogen production facility, product fluid 2 comprises from about 98 to 99.999 mole percent nitrogen. The invention will be described in detail in conjunction with the embodiment wherein industrial gas production facility 1 is an oxygen production facility.

Oxygen product fluid 2 from production facility 1 is combined with recycle stream 27, as will be more fully discussed below, to form industrial gas feed 3 which is passed to compression means comprising one or more compressors. In the embodiment of the invention illustrated in the FIGURE, the compression means comprises compressors 4 and 8. Industrial gas feed 3 has a pressure generally within the range of from 15 to 40 pounds per square inch absolute (psia). Industrial gas feed 3 is compressed to a pressure within the range of from 30 to 65 psia by passage through compressor 4 and resulting stream 5 is cooled of the heat of compression by passage through cooler 6. Resulting stream 7 is further compressed by passage through compressor 8 to produce elevated pressure industrial gas 9 at the use pressure which is generally within the range of from 40 to 500 psia. Elevated pressure industrial gas stream 9 is cooled of heat of compression by passage through cooler 10 to produce elevated pressure industrial gas 11.

A first portion 12 of elevated pressure industrial gas 11 is passed through valve 13 and as stream 14 to use point 40. First portion 12 will generally comprise from about 20 to 90 percent of elevated pressure industrial gas 11. Use point 40 may comprise any facility which uses industrial gas. For example, when the industrial gas in question is oxygen, use point 40 may be a chemical plant wherein the oxygen is used to carry out an oxidation reaction, a glassmaking plant wherein the oxygen is used for oxy-fuel combustion, a steelmaking plant wherein the oxygen is used for refining, etc. When the industrial gas in question is nitrogen, use point 40 may be a chemical plant wherein the nitrogen is used to carry out a nitrogenation reaction, an industrial facility wherein the nitrogen is used for blanketing or inerting purposes, etc.

The remaining portion of the elevated pressure industrial gas is used to provide the second and third portions which produce cryogenic liquefied industrial gas. In the embodiment illustrated in the FIGURE, the second and third portions are initially combined in a single stream 15 which comprises the remainder of elevated pressure industrial gas 11 after the first portion 12 has been split off for passage to use point 40.

Stream 15 is passed through valve 16 and as stream 17 is passed to heat exchanger 20. If desired stream 17 may be increased in pressure and/or precooled prior to being passed to heat exchanger 20. The elevated pressure industrial gas stream is reduced in temperature by passage through heat exchanger 20. After partial traverse of heat exchanger 20, elevated pressure industrial gas stream 17 is divided into stream 18 and into stream 21.

Stream 18 is the second portion of the elevated pressure industrial gas and comprises from about 9 to 89 percent of elevated pressure industrial gas 11. Second portion 18 has been cooled by the partial traverse of heat exchanger 18 to a temperature generally within the range of from 120° to 170° K. This cooled industrial gas stream is then passed through valve 19 and then as stream 24 to the inlet of turboexpander 25 wherein it is turboexpanded to a pressure generally within the range of from 17 to 45 psia. The resulting turboexpanded industrial gas is passed as stream 26 from the outlet of turboexpander 25 to the cold end of heat exchanger 20.

Turboexpanded industrial gas stream 26 is passed through heat exchanger 20 wherein it is warmed by indirect heat exchange with the cooling second portion and the cooling and condensing third portion. The third portion is illustrated as stream 21 and comprises from about 1 to 25 percent of elevated pressure industrial gas 11. This third portion is cooled by the initial partial traverse of heat exchanger 20 as part of stream 17, and then is condensed by the subsequent traverse of heat exchanger 20 as stream 21 to produce cryogenic liquefied industrial gas. This cryogenic liquefied industrial gas is passed as stream 21 through valve 22 and as stream 23 to storage facility 50, which typically comprises one or more tanks. If desired, flash-off vapor in stream 23 may be passed into stream 26 downstream of turboexpander 25 as illustrated by the broken line in the FIGURE.

The warmed turboexpanded industrial gas, which generally is at a temperature within the range of from 280° to 320° K., is withdrawn from the warm end of heat exchanger 20 as stream 27 and combined with stream 2 to form industrial gas feed stream 3, as was previously described, for passage to the compression means.

Table 1 presents the results of one example of the invention, using an embodiment similar to that illustrated in the FIGURE, wherein the industrial gas production facility was a vacuum pressure swing adsorption facility producing gaseous oxygen having a purity of 90 mole percent at a production rate of 75 tons per day. The use point was a copper smelter facility wherein the oxygen is used for enhanced combustion. The stream numbers in Table 1 correspond to those of the FIGURE. This example is presented for illustrative purposes and is not intended to be limiting.

TABLE 1

| Stream No. | Flow cfh, NTP | Temp K | Pressure Psia | Phase |
|---|---|---|---|---|
| 2 | 82,700 | 300 | 18 | Vapor |
| 3 | 152,200 | 305 | 18 | Vapor |
| 11 | 152,200 | 314 | 167 | Vapor |
| 14 | 75,300 | 314 | 167 | Vapor |
| 17 | 76,900 | 314 | 167 | Vapor |
| 23 | 7,400 | 96 | 165 | Liquid |
| 24 | 69,500 | 150 | 165 | Vapor |
| 26 | 69,500 | 94 | 20 | Vapor |
| 27 | 69,500 | 311 | 18 | Vapor |

Now by the use of this invention, one can produce cryogenic liquefied industrial gas proximate a use point in conjunction with the operation of an industrial gas production facility. Although the invention has been described in detail with reference to a certain preferred embodiment, those skilled in the art will recognize that there are other embodiments of the invention within the spirit and the scope of the claims.

We claim:

1. A method for producing cryogenic liquefied industrial gas comprising:

(A) passing industrial gas feed to compression means, compressing the industrial gas feed to produce elevated pressure industrial gas, and passing a first portion of the elevated pressure industrial gas to a use point;

(B) cooling a second portion of the elevated pressure industrial gas to produce cooled industrial gas, and condensing a third portion of the elevated pressure industrial gas to produce cryogenic liquefied industrial gas;

(C) turboexpanding the cooled industrial gas to produce turboexpanded industrial gas, and warming the turboexpanded industrial gas by indirect heat exchange with the second and third portions of the elevated pressure industrial gas to produce warmed turboexpanded industrial gas and said cooled industrial gas and said cryogenic liquefied industrial gas; and (D) passing the warmed turboexpanded industrial gas to said compression means as part of said industrial gas feed.

2. The method of claim 1 wherein the industrial gas is a fluid comprising from 30 to 99.5 mole percent oxygen.

3. The method of claim 1 wherein the industrial gas is a fluid comprising from 98 to 99.999 mole percent nitrogen.

4. The method of claim 1 wherein at least one of the second portion and the third portion of the elevated pressure industrial gas is increased in pressure prior to the indirect heat exchange with the turboexpanded industrial gas.

5. The method of claim 1 wherein at least one of the second portion and the third portion of the elevated pressure industrial gas is cooled prior to the indirect heat exchange with the turboexpanded industrial gas.

6. Apparatus for producing cryogenic liquefied industrial gas comprising:

(A) compression means for compressing an industrial gas feed to a use pressure;

(B) a heat exchanger, means for passing industrial gas from the compression means to a use point, and means for passing industrial gas from the compression means to the heat exchanger;

(C) a turboexpander, means for withdrawing cryogenic liquefied industrial gas from the heat exchanger, and means for passing industrial gas from the heat exchanger to the turboexpander and from the turboexpander to the heat exchanger; and (D) means for passing industrial gas from the heat exchanger to the compression means as industrial gas feed.

7. The apparatus of claim 6 further comprising a vacuum pressure swing adsorption industrial gas production facility in flow communication with the compression means.

8. The apparatus of claim 6 further comprising a membrane separation industrial gas production facility in flow communication with the compression means.

* * * * *